US009684269B1

(12) United States Patent
Matsubara et al.

(10) Patent No.: US 9,684,269 B1
(45) Date of Patent: Jun. 20, 2017

(54) TRANSPARENT BELT, LIGHT IRRADIATING DEVICE, AND IMAGE FORMING APPARATUS

(71) Applicant: FUJI XEROX CO., LTD., Tokyo (JP)

(72) Inventors: Takashi Matsubara, Kanagawa (JP); Tetsuro Kodera, Kanagawa (JP); Tomoko Miyahara, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/206,667

(22) Filed: Jul. 11, 2016

(30) Foreign Application Priority Data

Feb. 24, 2016 (JP) ..... 2016-033552
Feb. 24, 2016 (JP) ..... 2016-033553

(51) Int. Cl.
*G03G 15/20* (2006.01)

(52) U.S. Cl.
CPC ..... *G03G 15/2007* (2013.01)

(58) Field of Classification Search
CPC ..... G03G 15/2007
See application file for complete search history.

(56) References Cited

U.S. PATENT DOCUMENTS 5,196,870 A * 3/1993 Itoh ..... B41J 19/20 347/130
9,372,453 B2 * 6/2016 Hidaka ..... G03G 15/2053
9,465,332 B1 * 10/2016 Uehara ..... G03G 15/2007
2006/0115305 A1 * 6/2006 Lofthus ..... G03G 15/2007 399/328
2014/0169820 A1 * 6/2014 Kusumoto ..... G03G 15/2053 399/69
2014/0241765 A1 8/2014 Kodera

FOREIGN PATENT DOCUMENTS

JP 2014-164022 A 9/2014
JP 2015-125390 A 7/2015

* cited by examiner

*Primary Examiner* — Ryan Walsh
(74) *Attorney, Agent, or Firm* — Oliff PLC

(57) ABSTRACT

Provided is a transparent belt which is wound around a transparent roll and pressed at a nip portion and through which light from a light source transmits, the transparent belt including a base material layer, and an elastic layer that is exposed on a transparent roll side with respect to the base material layer and is elastically deformed greater than the base material layer in the nip portion.

6 Claims, 6 Drawing Sheets

COMPARATIVE EXAMPLE

TRANSPARENT BELT, LIGHT IRRADIATING DEVICE, AND IMAGE FORMING APPARATUS

CROSS-REFERENCE TO RELATED APPLICATIONS

This application is based on and claims priority under 35 USC 119 from Japanese Patent Application Nos. 2016-033552 filed Feb. 24, 2016 and 2016-033553 filed Feb. 24, 2016.

BACKGROUND

Technical Field

The invention relates to a transparent belt, a light irradiating device, and an image forming apparatus.

SUMMARY

According to an aspect of the invention, there is provided a transparent belt which is wound around a transparent roll and pressed at a nip portion and through which light from a light source transmits, the transparent belt including:

a base material layer; and an elastic layer that is exposed on a transparent roll side with respect to the base material layer and is elastically deformed greater than the base material layer in the nip portion.

BRIEF DESCRIPTION OF THE DRAWINGS

Exemplary embodiments of the present invention will be described in detail based on the following figures, wherein.

DETAILED DESCRIPTION

First Exemplary Embodiment

An example of a transparent belt, a light irradiating device, and an image forming apparatus according to a first exemplary embodiment will be described.

Overall Configuration

Figure 1:
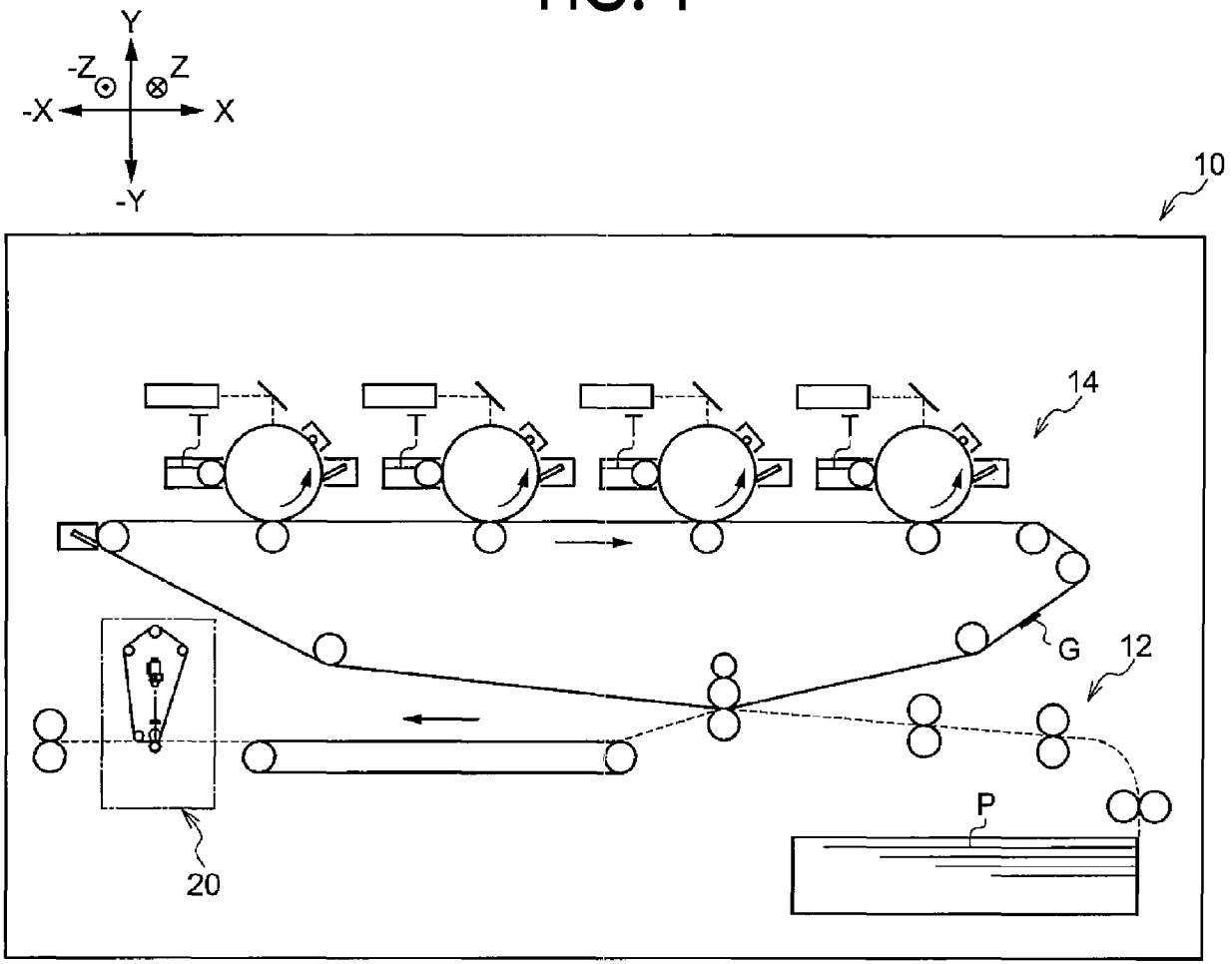
FIG. 1 is a view of an overall configuration schematically illustrating an image forming apparatus according to a first exemplary embodiment.

An image forming apparatus 10 of the first exemplary embodiment is illustrated in FIG. 1. The image forming apparatus 10 has, as one example, a transporting portion 12 that transports a sheet P, an image forming portion 14 that forms a toner image G on the transported sheet P by using toner T, and a fixing device 20 that fixes the toner image G formed by the image forming portion 14 onto the sheet P. The sheet P is one example of a recording medium. The toner T is one example of a developer. The toner image G is one example of a developer image and a light irradiating target. The image forming portion 14 is one example of a developer image forming unit. Furthermore, the image forming portion 14 performs each step of charging, exposing, developing, transferring, and cleaning. In addition, the fixing device 20 is one example of a light irradiating device.

Moreover, in the following description, a direction indicated by an arrow Y in FIG. 1 is a height direction of the image forming apparatus 10 and a direction indicated by an arrow X in FIG. 1 is a width direction. In addition, a direction (indicated by Z) orthogonal to each of the height direction and the width direction is a depth direction. Then, the width direction, the height direction, and the depth direction are respectively described as an X direction, a Y direction, and a Z direction when the image forming apparatus 10 is viewed (in front view) from a side on which a user (not illustrated) stands. Furthermore, in a case where it is necessary to distinguish one side and the other side of each of the X direction, the Y direction, and the Z direction, when the image forming apparatus 10 is viewed in front view, an upper side is referred to as a Y side, a lower side is referred to as a −Y side, a right side is referred to as an X side, a left side is referred to as a −X side, a rear side is referred to as a Z side, and a front side is referred to as a −Z side.

Main Configuration

Next, the fixing device 20 will be described.

Figure 2:
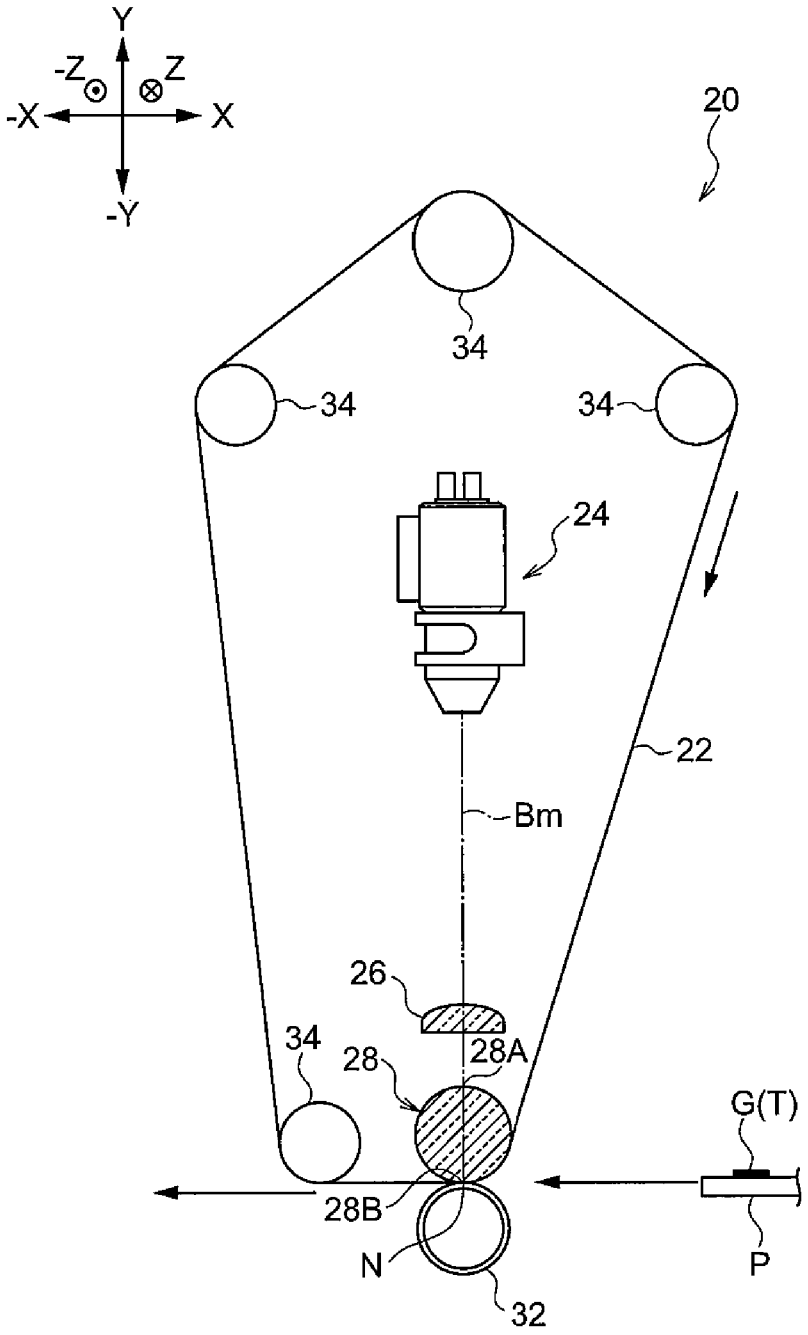
FIG. 2 is a view of a configuration schematically illustrating a fixing device according to the first exemplary embodiment.

As illustrated in FIG. 2, the fixing device 20 has a transparent belt 22, a light source 24, a condensing lens 26, a transparent roll 28, a pressure roll 32, and belt support rolls 34. The pressure roll 32 is one example of a pressure member.

Light Source

The light source 24 includes, as one example, plural laser arrays (not illustrated) that are arranged in the Z direction and emit a laser beam Bm toward the Y side and a collimating lens (not illustrated) that causes the laser beam Bm emitted from the laser arrays to be parallel light. In addition, the light source 24 is disposed on an inside of the transparent belt 22 and causes the laser beam Bm to be incident on the condensing lens 26 which will be described later. Then, the light source 24 irradiates the toner image G with the laser beam Bm through the condensing lens 26, the transparent roll 28, and the transparent belt 22. The laser beam Bm is one example of the light.

Moreover, in the exemplary embodiment, as one example, a longitudinal direction of the light source 24 is the Z direction, a direction on which the laser beam Bm is applied to the toner image G is the Y direction, and a direction which is orthogonal to the Z direction and the Y direction, and on which the sheet P is transported is the X direction. The sheet P is transported, as one example, from the X side to the −X side.

Condensing Lens

The condensing lens 26 is disposed on an optical axis of the laser beam Bm between the light source 24 and the transparent roll 28. In addition, the condensing lens 26 is a plano-convex lens condensing the laser beam Bm irradiated from the light source 24 on a nip portion N which will be described below.

Transparent Roll

The transparent roll 28, of which an axial direction is the Z direction, is rotatably provided on the inside of the transparent belt 22 and on the Y side of a transport path in which the sheet P is transported. In addition, the transparent roll 28 is in contact with an inner circumferential surface of the transparent belt 22. Furthermore, the transparent roll 28 is an optical member that transmits the laser beam Bm from the light source 24 and condenses the laser beam Bm toward the nip portion N which will be described below, and is configured with, as one example, a glass roll that is a cylindrical (solid) rod glass. The optical axis of the laser beam Bm passes through a center of the transparent roll 28 when the transparent roll 28 is viewed in the Z direction.

A portion where the laser beam Bm is incident on an outer circumferential surface of the transparent roll 28 is referred to as an incident portion 28A. The incident portion 28A is a range (portion) including a top portion of the transparent roll 28 in the Y direction when the transparent roll 28 is viewed in the Z direction. On the other hand, a portion shifted from the incident portion 28A by 180 degrees on the outer circumferential surface of the transparent roll 28 is referred to as a pressure portion 28B. The pressure portion 28B is a portion in which the outer circumferential surface of the transparent roll 28 comes into contact with the inner circumferential surface of the transparent belt 22.

Moreover, in the exemplary embodiment, "transparent" in the transparent belt 22 and the transparent roll 28 means that transparency is sufficiently high in a wavelength range of the laser beam Bm. That is, the transparent belt 22 and the transparent roll 28 may transmit the laser beam Bm, and the higher the transparency is, the better from a viewpoint of light utilization efficiency is. The transparency may be, as one example, equal to or greater than 90% and may be preferably equal to or greater than 95%.

Pressure Roll

The pressure roll 32 is formed of, as one example, a cylindrical shape, which is made of stainless steel, and has a shaft portion (not illustrated). In addition, the pressure roll 32, of which an axial direction is the Z direction, is rotatably provided on the −Y side of the transport path in which the sheet P is transported. Furthermore, the pressure roll 32 is disposed so that a predetermined pressurizing force acts between the pressure roll 32 and the transparent belt 22. In other words, the pressure roll 32 sandwiches the sheet P on which the toner image G is formed and the transparent belt 22 together with the transparent roll 28, presses the sheet P and the transparent belt 22, and transports the sheet P and the transparent belt 22 on the −X side.

Here, the transparent belt 22 and the sheet P are sandwiched between the transparent roll 28 and the pressure roll 32, and a portion (region) in which the toner image G is pressed is referred to as the nip portion N. That is, the pressure roll 32 presses the toner image G on the sheet P and the transparent belt 22 toward the transparent roll 28 and forms the nip portion N. In addition, the nip portion N is a portion in which the toner image G (toner T) on the sheet P is heated by the laser beam Bm.

Transparent Belt

The transparent belt 22 is formed in an endless type. In addition, the transparent belt 22 is wound around, as one example, four belt support rolls 34 and the transparent roll 28 of which axial directions are the Z direction. Then, the belt support roll 34 is driven by gears and a motor (not illustrated) to be rotated and thereby the transparent belt 22 is circularly moved. The laser beam Bm transmits the nip portion N that is pressed by the pressure roll 32 in the transparent belt 22. Furthermore, the transparent belt 22 comes into contact with the toner image G (toner T) on the sheet P in the nip portion N. That is, the toner image G is pressed while being heated by the laser beam Bm in the nip portion N and is fixed onto the sheet P.

Figure 3:
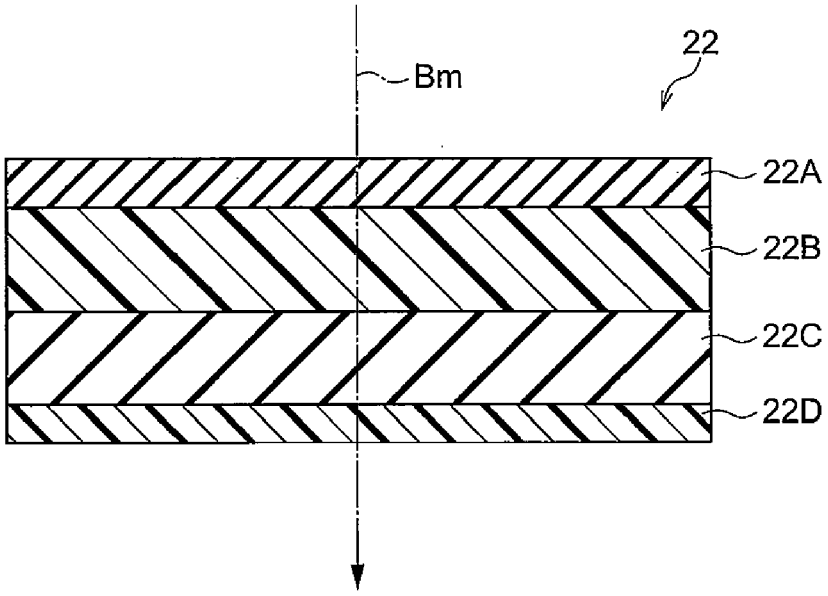
FIG. 3 is a vertical sectional view illustrating a part of a layer structure of a transparent belt according to the first exemplary embodiment.

As illustrated in FIG. 3, the transparent belt 22 has a four-layer structure having, as one example, an elastic layer 22A, a base material layer 22B that is laminated on the elastic layer 22A, an intermediate layer 22C that is laminated on the base material layer 22B, and a release layer 22D that is laminated on the intermediate layer 22C. Moreover, a primer layer (not illustrated) is formed between the elastic layer 22A, the base material layer 22B, the intermediate layer 22C, and the release layer 22D to enhance adhesion.

Elastic Layer

The elastic layer 22A is the innermost layer of the transparent belt 22 closest to the transparent roll 28 side (inside) and is exposed. In addition, the elastic layer 22A is configured with, as one example, silicone rubber that is thicker than the base material layer 22B which will be described below and transmits the laser beam Bm. Moreover, in FIGS. 2 and 3, the laser beam Bm is indicated by a one-dotted chain line for simplification. Moreover, in the exemplary embodiment, the "elastic layer" is a layer that is elastically deformed greater than the base material layer 22B in the thickness direction when being pressed in the nip portion N (see FIG. 2). Moreover, other materials in addition to the silicone rubber, for example, may be chloroprene rubber, butyl rubber, acrylic rubber, urethane rubber, nitrile rubber, fluororubber, styrene-butadiene rubber, and the like.

Base Material Layer

The base material layer 22B is a layer for maintaining a required strength as the transparent belt 22. In addition, the base material layer 22B is configured with, as one example, polyimide and transmits the laser beam Bm. Moreover, other materials which may be used in addition to polyimide, may be polyvinylidene fluoride (PVDF), polyethylene (PE), polyurethane (PU), and polydimethylsiloxane (PDMS). In addition, other materials, which may be used in addition to polyimide, may be, polyetheretherketone (PEEK), polyether sulfone (PES), fluorinated ethylene propylene (FEP), and ethylene tetrafluoroethylene copolymer (ETFE). Furthermore, other materials, which may be used in addition to polyimide, may be chlorotrifluoroethylene (CTFE), polyvinylidene fluoride (PVDF), polyvinyl fluoride (PVF), and polytetrafluoroethylene (PTFE). Moreover, the base material layer 22B may be configured with a combination of the materials described above.

Intermediate Layer

The intermediate layer 22C is configured with, as one example, silicone rubber and transmits the laser beam Bm. Moreover, in the exemplary embodiment, as one example, the elastic layer 22A and the intermediate layer 22C are configured with the same material (silicone rubber).

Release Layer

The release layer 22D is configured with, as one example, tetrafluoroethylene perfluoroalkoxy ethylene copolymer (PFA) and transmits the laser beam Bm. In addition, the release layer 22D suppresses adhesion of the toner image G (see FIG. 2) to the transparent belt 22, as compared to a configuration in which the release layer 22D is absent. Other materials configuring the release layer 22D may be, for example, tetrafluoroethylene polymer (PTFE), tetrafluoroethylene hexafluoropropylene copolymer (FEP), ethylene tetrafluoroethylene copolymer (ETFE), and the like. Moreover, the release layer 22D also has a function of applying favorable gloss to the toner image G after the toner image G is fixed in cooperation with the intermediate layer 22C.

Comparative Example

Figure 6:
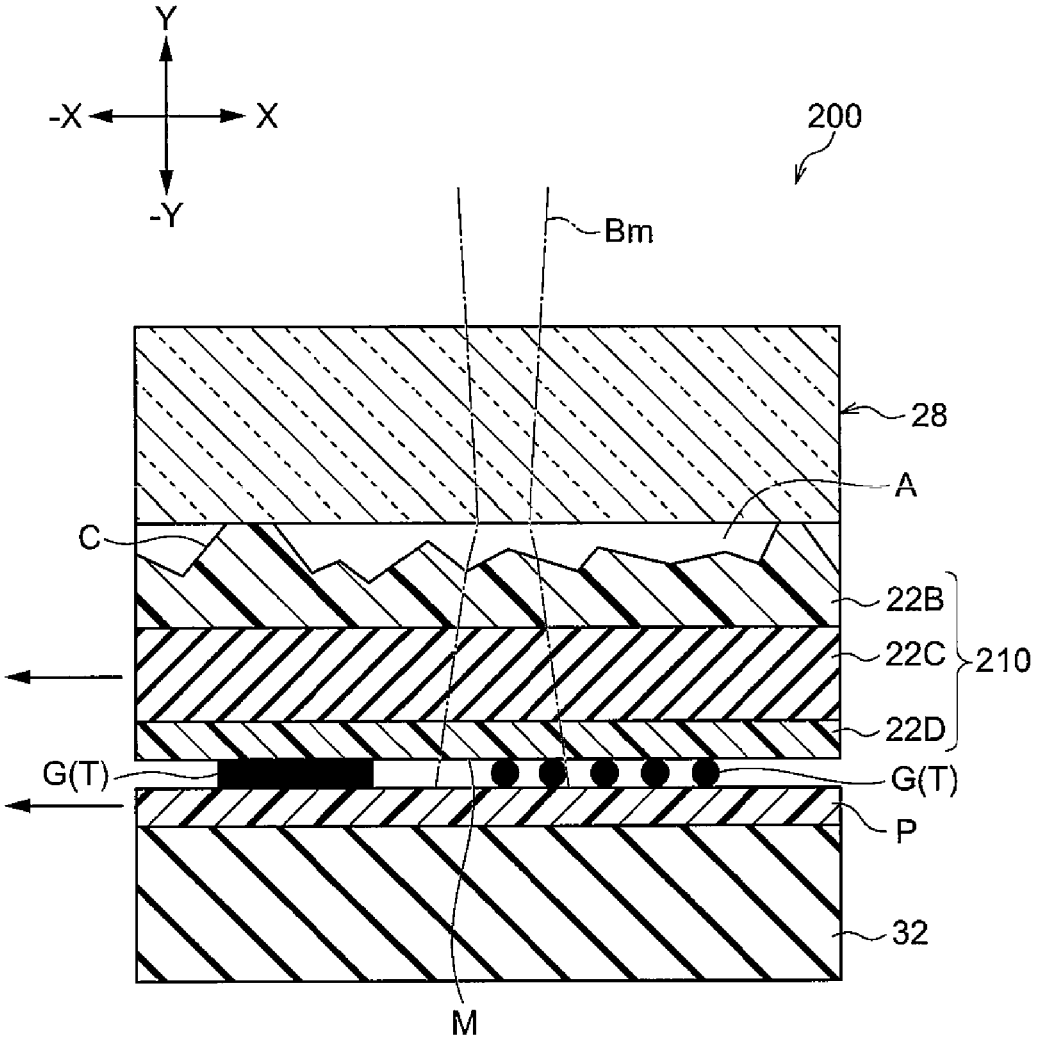
FIG. 6 is an explanatory view schematically illustrating a state where light is applied to a nip portion of a fixing device according to a comparative example.

A nip portion M of a fixing device 200 of a comparative example is illustrated in FIG. 6. A transparent belt 210 is provided in the fixing device 200 in place of the transparent belt 22 (see FIG. 2) in the fixing device 20 (see FIG. 2) of the exemplary embodiment and other configurations are similar to those of the fixing device 20. The transparent belt 210 has a three-layer structure having the base material layer 22B, the intermediate layer 22C, and the release layer 22D in order from the inside to the outside. That is, in the transparent belt 210, the base material layer 22B is disposed on a side which is the nearest side to the transparent roll 28 and the transparent belt 210 does not have the elastic layer 22A (see FIG. 3). Moreover, a nip portion between the transparent belt 210 and the pressure roll 32 is referred to as a nip portion M in the fixing device 200.

In the fixing device 200 of the comparative example, when the transparent belt 210 is circularly moved, scratch C may occur on a surface (inner circumferential surface of the transparent belt 210) of the base material layer 22B by wear due to contact between the belt support roll 34, the transparent roll 28, and the base material layer 22B. In this case, roughness of the surface of the base material layer 22B is larger than roughness of the surface of the transparent roll 28. Therefore, many air layers A (gaps) are present between the surface of the base material layer 22B in which the scratch C occurs and the surface of the transparent roll 28.

Here, a refractive index of light of air is approximately 1.0 (see JIS B 7071-1) while a refractive index of light of the transparent roll 28 is approximately 1.5 (JIS B 7071-1) and a refractive index of light of the base material layer 22B is approximately 1.7 (JIS K 7142). That is, in the fixing device 200 of the comparative example, since a difference in the refractive index of light between the transparent roll 28 and the air layer A is greater than a difference in the refractive index of light between the transparent roll 28 and the base material layer 22B, the laser beam Bm transmitting the transparent roll 28 is likely to be scattered when the laser beam Bm is incident on the air layer A. In other words, in the fixing device 200 of the comparative example, condensing performance of the laser beam Bm to the nip portion M is decreased.

Operation

Next, an operation of the first exemplary embodiment will be described.

In the fixing device 20 illustrated in FIG. 2, the laser beam Bm emitted from the light source 24 is incident on the nip portion N through the condensing lens 26, the transparent roll 28, and the transparent belt 22. Then, in the nip portion N, the laser beam Bm is absorbed into the toner T on the sheet P. Therefore, the toner image G is pressed by the pressurizing force for acting on the nip portion N while being heated and is fixed onto the sheet P.

Figure 4:
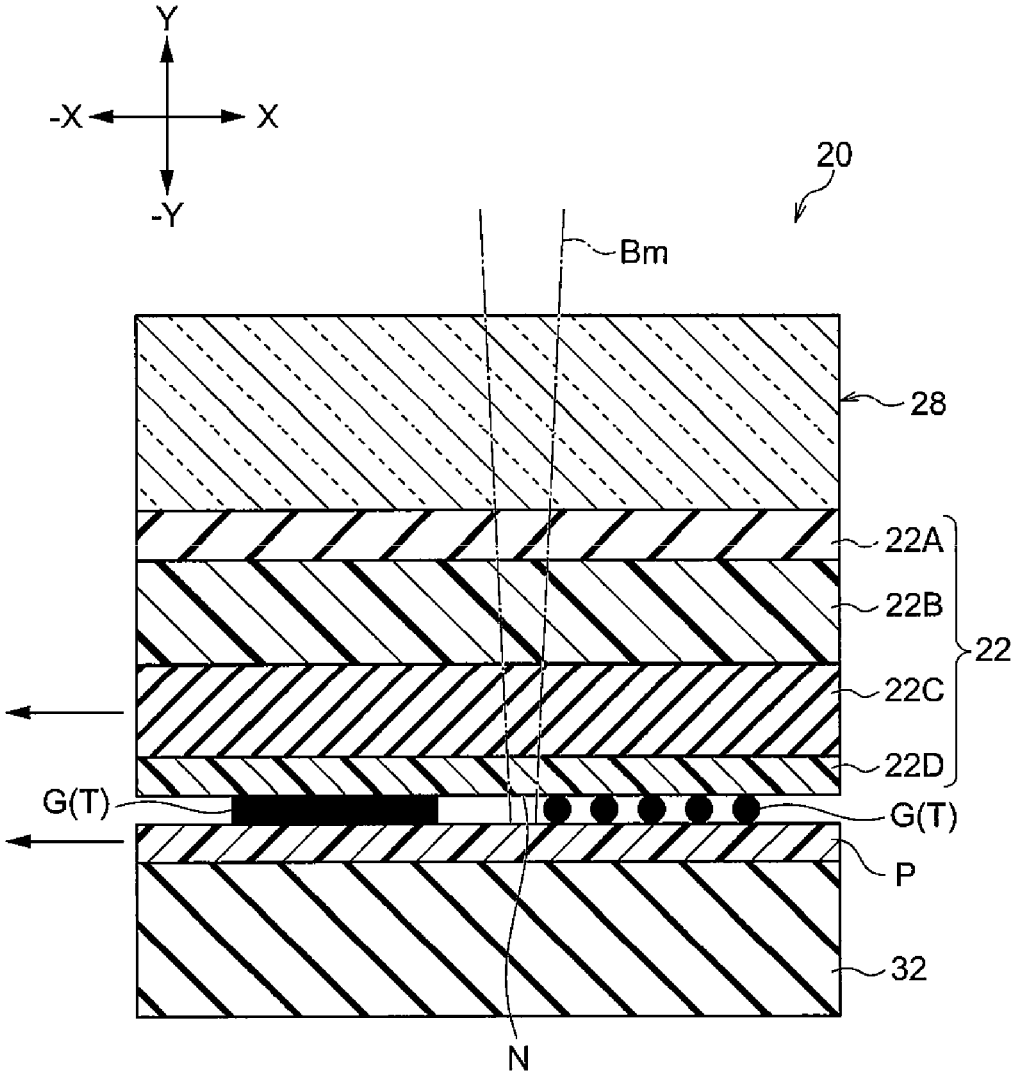
FIG. 4 is an explanatory view schematically illustrating a state where light is applied to a nip portion of the fixing device according to the first exemplary embodiment.

Here, as illustrated in FIG. 4, in the fixing device 20, the elastic layer 22A is formed on the inner circumferential surface of the transparent belt 22. Therefore, in the transparent belt 22 that is circularly moved, even if the elastic layer 22A is worn (even if the scratch occurs) by contact with the transparent roll 28, the elastic layer 22A is elastically deformed (compressed) by the pressurizing force acting on the nip portion N and thereby unevenness of the elastic layer 22A is reduced. Therefore, the air layer is unlikely to be formed (air layer is reduced) in an interface between the transparent roll 28 and the transparent belt 22. Moreover, in FIG. 4, the transparent roll 28 is illustrated in the plate shape.

A configuration in which the air layer is unlikely to be formed in the interface between the transparent roll 28 and the transparent belt 22 means that the laser beam Bm transmitted through the transparent roll 28 is incident on the elastic layer 22A in which a difference in the refractive index of light with the transparent roll 28 is small. That is, in the fixing device 20, scattering of the laser beam Bm between the transparent roll 28 and the transparent belt 22 is suppressed, as compared to the comparative example described above. In other words, in the fixing device 20, since the condensing performance of the laser beam Bm toward the nip portion N is improved, as compared to the comparative example, an decrease in the light amount of the laser beam Bm applied to the toner image G (toner T) is suppressed.

In addition, in the fixing device 20 illustrated in FIG. 2, since the decrease in the condensing performance of the laser beam Bm toward the toner T is suppressed, a heating temperature of the toner T is suppressed to be lowered lower than a predetermined fixing temperature. Therefore, since a heat amount required to be fixed is applied to the toner T, fixing failure (for example, cold offset) of the toner image G onto the sheet P is suppressed, as compared to the fixing device 200 (see FIG. 6) of the comparative example.

In the image forming apparatus 10 illustrated in FIG. 1, since fixing failure of the toner image G is suppressed in the fixing device 20, as compared to the configuration having the fixing device 200 (see FIG. 6) of the comparative example, image failure (for example, glossiness reduction in the image) by the fixing failure is suppressed.

Second Exemplary Embodiment

Next, an example of a transparent belt, a light irradiating device, and an image forming apparatus according to a second exemplary embodiment will be described. Moreover, the same reference numerals as the first exemplary embodiment are given to basically the same members and portions as in the first exemplary embodiment described above and the description will be omitted.

Figure 5:
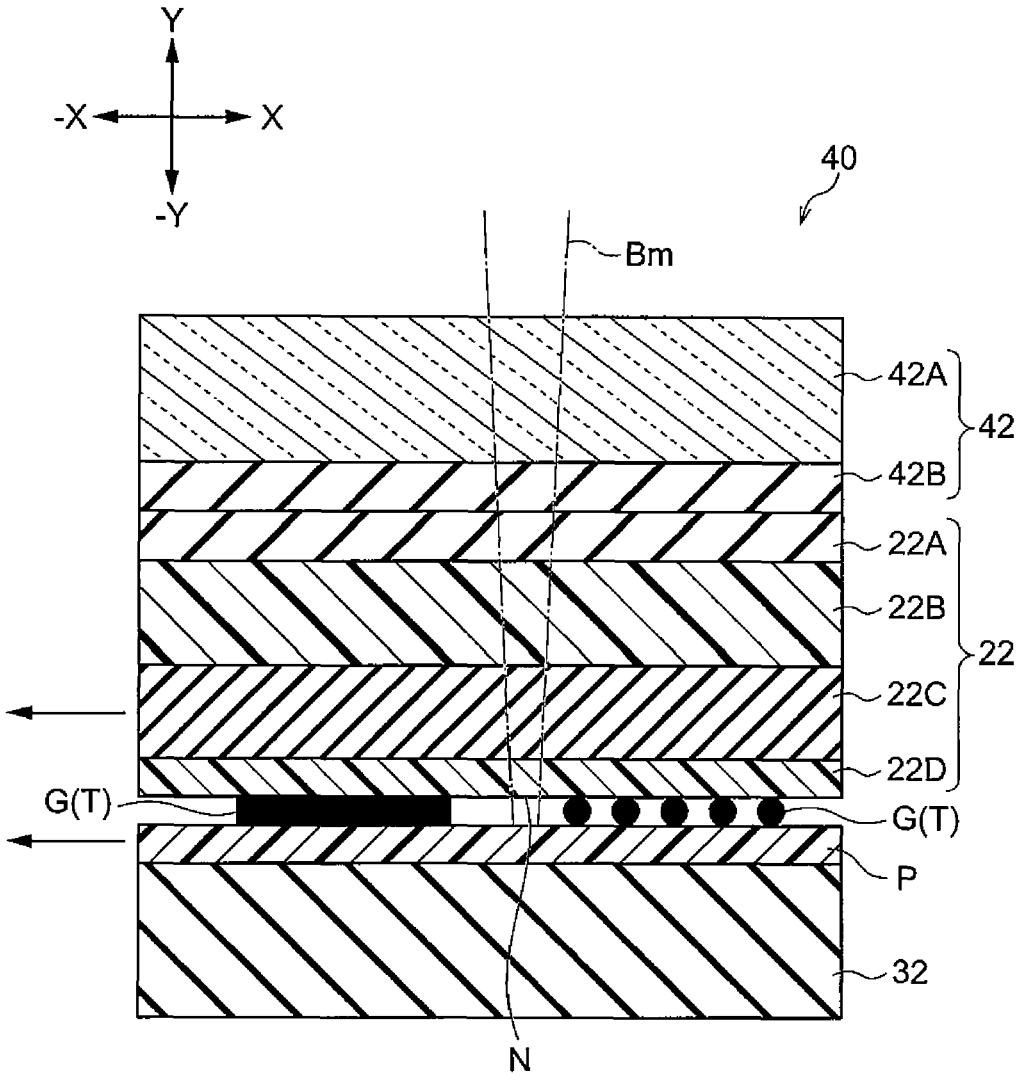
FIG. 5 is an explanatory view schematically illustrating a state where light is applied to a nip portion of a fixing device according to a second exemplary embodiment.

A nip portion N of a fixing device 40 of the second exemplary embodiment is illustrated in FIG. 5. The fixing device 40 is one example of the light irradiating device. The fixing device 40 includes the transparent belt 22, the light source 24, the condensing lens 26 (see FIG. 2), a transparent roll 42, and the pressure roll 32.

Transparent Belt

The transparent roll 42 is an optical member transmitting the laser beam Bm from the light source 24 (see FIG. 2) and condensing the light to the nip portion N, and is configured with, as one example, a glass roll that is a cylindrical (solid) rod lens. Specifically, the transparent roll 42 has a base layer 42A and a roll-side elastic layer 42B laminated on the base layer 42A. Moreover, in FIG. 5, the transparent roll 42 is illustrated in the plate shape.

The base layer 42A is configured with a glass roll similar to the transparent roll 28 (see FIG. 2) of the first exemplary embodiment. The roll-side elastic layer 42B is exposed on the transparent belt 22 side with respect to the base layer 42A and is made to be elastically deformed greater than the base layer 42A in the nip portion N. The roll-side elastic layer 42B is configured with, as one example, silicone rubber similar to the elastic layer 22A (see FIG. 3) described above.

In addition, the transparent roll 42, of which an axial direction is the Z direction, is rotatably provided on an inside of the transparent belt 22 and on the Y side in a transport path in which the sheet P is transported. In addition, the transparent roll 42 is in contact with an inner circumferential surface of the transparent belt 22. An optical axis of the laser beam Bm passes through the center of the transparent roll 42 when the transparent roll 42 is viewed in the Z direction. Moreover, in the exemplary embodiment, "transparent" in the transparent roll 42 means that transparency is sufficiently high in a wavelength range of the laser beam Bm. That is, the transparent roll 42 may transmit the laser beam Bm, and the higher the transparency is, the better the light utilization efficiency is. The transparency may be, as one example, equal to or greater than 90% and may be preferably equal to or greater than 95%.

Operation

Next, an operation of the second exemplary embodiment will be described.

As illustrated in FIG. 5, in the fixing device 40, the elastic layer 22A is formed on an inner circumferential surface of the transparent belt 22 and the roll-side elastic layer 42B is formed on an outer circumferential surface of the transparent roll 42. Therefore, even if the elastic layer 22A and the roll-side elastic layer 42B are worn (even if scratch occurs) by contact between the elastic layer 22A and the roll-side elastic layer 42B, the elastic layer 22A and the roll-side elastic layer 42B are elastically deformed (compressed) by a pressurizing force acting on the nip portion N. Therefore, since unevenness of the contact portion between the elastic layer 22A and the roll-side elastic layer 42B is reduced, an air layer is unlikely to be formed (air layer is reduced) in an interface between the transparent roll 42 and the transparent belt 22, as compared to the comparative example described above.

The configuration in which the air layer is unlikely to be formed in the interface between the transparent roll 42 and the transparent belt 22 means that the laser beam Bm transmitting the transparent roll 42 is incident on the elastic layer 22A in which a difference in the refractive index of light with the transparent roll 42 is small. That is, in the fixing device 40, scattering of the laser beam Bm between the transparent roll 42 and the transparent belt 22 is suppressed, as compared to the comparative example described above. In other words, in the fixing device 40, since the condensing performance of the laser beam Bm toward the nip portion N is improved, as compared to the comparative example, a decrease in the light amount of the laser beam Bm applied to the toner image G (toner T) is suppressed.

In addition, in the fixing device 40, since the decrease in the condensing performance of the laser beam Bm toward the toner T is suppressed, a heating temperature of the toner T is suppressed to be lowered lower than a predetermined fixing temperature. Therefore, since a heat amount required to be fixed is applied to the toner T, fixing failure (for example, cold offset) of the toner image G onto the sheet P is suppressed, as compared to the fixing device 20 (see FIG. 2).

In the image forming apparatus 10 (see FIG. 1) having the fixing device 40, since the fixing failure of the toner image G is suppressed in the fixing device 40, as compared to the configuration having the fixing device 20 (see FIG. 2), image failure (for example, glossiness reduction in the image) by the fixing failure is suppressed.

Moreover, the exemplary embodiments of the invention are not limited to the exemplary embodiments described above.

Examples of the light irradiating device are not limited to the fixing devices 20 and 40 which fix the toner T onto the sheet P. For example, the light irradiating device may be a device that preliminarily heats the toner image by the laser beam Bm before a liquid developer adhered on the sheet P is fixed by a liquid developing method. In addition, the light irradiating device may be a drying device that removes moisture in the sheet P. Furthermore, the light irradiating device may be a bonding device that performs bonding by melting resin by irradiation of the light or may be a curing device that cures a light irradiating target by irradiation of the light.

In a case where a bonding force between the toner T and the intermediate layer 22C is low, the release layer 22D may not be formed in the transparent belt 22. In addition, in a configuration in which the outer circumferential surface of the transparent roll 28 is cleaned by using a soft cleaning blade, oil may be applied on the inner circumferential surface of the transparent belt 22.

According to the configuration in which the laser beam Bm is converged toward the nip portion N, the transparent roll 28 is not limited to solid and may be hollow. In addition, the transparent roll 28 is not limited to be made of glass and, for example, may be made of resin as arcrylic.

If the elastic layer 22A and the roll-side elastic layer 42B are elastically deformable so that the surfaces have a small air layer, a surface treatment for improving wear resistance may be applied to the surfaces.

The pressure roll 32 is not only made of stainless steel but also made of aluminum or made of other metals. In addition, the elastic layer and the release layer may be provided on the surfaces.

The light source 24 may be provided on an outside of the transparent belt 22.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transparent belt which is wound around a transparent roll and pressed at a nip portion and through which light from a light source transmits, the transparent belt comprising:

a base material layer; and an elastic layer that is exposed on a transparent roll side with respect to the base material layer and is elastically deformed greater than the base material layer in the nip portion.

2. The transparent belt according to claim 1, wherein the elastic layer is made of at least one selected from the group consisting of silicone rubber, chloroprene rubber, butyl rubber, acrylic rubber, urethane rubber, nitrile rubber, fluororubber, and styrene-butadiene rubber.

3. A light irradiating device comprising:

the transparent belt according to claim 1 that comes into contact with a light irradiating target;

the transparent roll that is rotatably provided on an inside of the transparent belt and comes in contact with the transparent belt;

the light source that irradiates the light irradiating target with the light through the transparent roll and the transparent belt; and a pressure member that presses the light irradiating target and the transparent belt toward the transparent roll to form a nip portion.

4. The light irradiating device according to claim 3, wherein the transparent roll comprises:

a base layer; and a roll-side elastic layer that is exposed on a transparent belt side with respect to the base layer and is elastically deformed greater than the base layer in the nip portion.

5. An image forming apparatus comprising:

a developer image forming unit that forms a developer image on a recording medium; and the light irradiating device according to claim 4 that irradiates the developer image on the recording medium formed by the developer image forming unit with the light.

6. An image forming apparatus comprising:

a developer image forming unit that forms a developer image on a recording medium; and the light irradiating device according to claim 3 that irradiates the developer image on the recording medium formed by the developer image forming unit with the light.

* * * * *